US005445437A

United States Patent [19]

Adamson

[11] Patent Number: 5,445,437

[45] Date of Patent: Aug. 29, 1995

[54] CONCRETE GROOVING APPARATUS AND METHOD

[76] Inventor: Darrel M. Adamson, 918 Plum Tree La., Sarasota, Fla. 34243

[21] Appl. No.: 231,776

[22] Filed: Apr. 25, 1994

[51] Int. Cl.[6] ..... E01C 23/09

[52] U.S. Cl. ..... 299/39; 125/14; 404/90

[58] Field of Search ..... 404/89, 90, 93, 94; 299/39; 51/176; 125/14

[56] References Cited

U.S. PATENT DOCUMENTS

| | | | |
|---|---|---|---|
| 4,256,344 | 3/1981 | Hatcher | 299/39 |
| 4,764,051 | 8/1988 | Whitney | 404/94 X |
| 4,792,190 | 12/1988 | Bertrand | 404/90 X |
| 5,176,426 | 1/1993 | Adamson | 299/39 |

*Primary Examiner*—David J. Bagnell
*Attorney, Agent, or Firm*—David Kiewit

[57] ABSTRACT

A concrete grooving apparatus small and light enough to be manually propelled by an operator cuts decorative grooved patterns into a pavement surface. The apparatus includes a linear tracking mechanism guiding a cutter along a plurality of lines intersecting at a variety of preselected angles, and thus allows an operator to cut herringbone, diamond, and other polygonal patterns. The apparatus also includes an arcuate tracking mechanism for cutting a groove with a radius of curvature smaller than the length of the cart used to carry the cutting wheel. An out-of-round contour-following wheel is used in combination with a cutting wheel having a V-shaped or semi-circular profile to engrave an undulating groove into a paved surface, which produces a wavy-edged or cobblestone-like pattern.

15 Claims, 6 Drawing Sheets

64
58
28
68
66
55
54
56
76
49
30
60
62
20
38
70
25
24
D

CONCRETE GROOVING APPARATUS AND METHOD

BACKGROUND OF THE INVENTION

Concrete engravers for making decorative grooved patterns in the surface of hardened or cured concrete, pavement, or the like are known in the art. Notable among these is an earlier teaching by Adamson in U.S. Pat. No. 5,176,426, the disclosure of which is herein incorporated by reference. The apparatus of U.S. Pat. No. 5,176,426 is generally useful for making grooves referred to as "transverse" grooves (for which a small cart that carries the cutting wheel is guided along the groove path by a tracking arrangement portion of the apparatus) and for making grooves referred to as "longitudinal", for which the cart is held stationary and a cutter carriage moves relative to the cart in order both to translate the cutting wheel along the longitudinal groove path, and to move it vertically between a preset cutting position and a higher elevation at which the cutter does not engage the concrete.

The concrete engraver taught in U.S. Pat. No. 5,176,426 includes a body with a perimeter frame used to limit the cutting depth of one of two mutually perpendicular circular cutting wheels. The perimeter frame includes aligned linear cams, i.e., raised attachments to the frame. The longitudinal-groove cutter is mounted in a carriage on two linear guide shafts and uses a rotatable cam follower in the process of making a longitudinal groove. When this is done, the cam follower rolls down a lead-in ramp, traverses a portion of the frame and then either stops or rolls up a second ramp and thereby makes a groove of predetermined length and depth. The maximum length of the longitudinal cut is limited by the length of that part of the frame that is between the lead-in ramps of the linear cams.

SUMMARY OF THE INVENTION

The apparatus of the invention includes a powered circular cutter, a small cart that carries the cutter and that has vertical and horizontal positioning controls for the cutting wheel, as well as several tracking arrangements to guide a cutting wheel along a preselected path to cut grooves into a paved surface.

Therefore, it is an object of the invention to provide a concrete grooving apparatus with a single cutter that can be selectively repositioned into one of two mutually perpendicular orientations.

It is a further object of the invention to provide a concrete grooving apparatus with contour-following wheels to set the groove depths of cuts made in either of two mutually perpendicular orientations.

It is a specific object of the invention to provide a concrete grooving apparatus employing an eccentrically mounted contour-following wheel in combination with a cutting wheel that has a V-shaped or semi-circular profile in order to engrave a undulating groove into a paved surface, thereby producing a cobblestone-like, or wavy-edged pattern.

It is a further specific object of the invention to provide a concrete grooving apparatus employing an out-of-round contour-following wheel in combination with a cutting wheel that has a V-shaped or semi-circular profile in order to engrave a undulating groove into a paved surface, thereby producing a cobblestone-like, or wavy-edged pattern.

It is yet a further object of the invention to provide a concrete grooving apparatus including a linear tracking mechanism that guides a cutter along a plurality of lines that intersect at controlled angles, whereby an operator can cut herringbone, diamond, and other polygonal patterns.

It is yet a further object of the invention to make a concrete engraver that is small and light enough so that it can be propelled by its operator.

It is an additional object of the invention to provide a concrete engraver with the cutter placed outside the footprint of the support wheels so that it can be used closer to walls and other obstructions.

It is yet an additional object of the invention to provide a concrete engraver capable of cutting an arcuate groove having a radius of curvature smaller than the length of a cart used to carry the cutting wheel.

DETAILED DESCRIPTION

Figure 1:
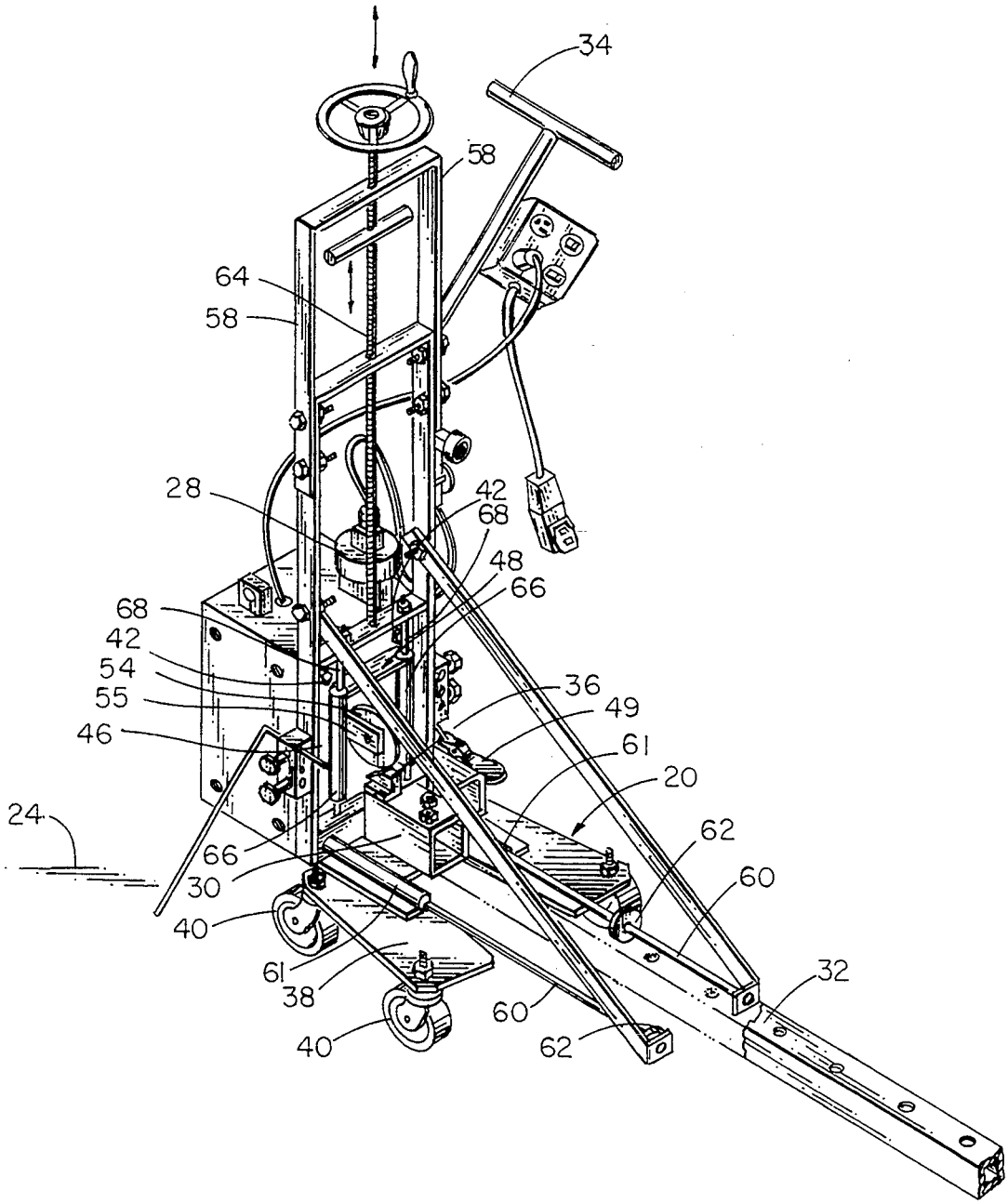
FIG. 1 of the drawing is a rear perspective view of the cutter-carrying cart of the invention.

Turning originally to FIG. 1 of the drawing, one finds a cutter-carrying cart 20 portion of the pavement grooving apparatus of the invention. This cart serves the same general purposes as the somewhat larger cart disclosed in the inventor's earlier U.S. Pat. No. 5,176,426, in that it carries a rotary cutter 22 used to groove a pavement surface 24 and form a decorative pattern on that surface. As was well known in the art before U.S. Pat. No. 5,176,426, the cutting wheel 25 of a rotary cutter 22 is commonly cooled with water supplied through a hose (not shown). The water, cutting debris etc. may then be removed with a wet or dry vacuum cleaning system, of which only an inlet or suction pipe 28 is shown in the drawing. The cart 20 also has an elongate receiver 30 attached to or integrally formed in it. The receiver 30 is used to retain one end of a connecting bar 32 that is part of the apparatus used to guide the cutter 22 across pavement.

The cart 20 of the invention is smaller and lighter than the corresponding equipment of U.S. Pat. No. 5,176,426. Like that earlier apparatus, it has several ground support wheels (e.g., the four caster wheels 40 shown in the drawing), but does not incorporate an engine-driven wheel. Instead, an operator propels the cart 20, e.g., by using a push handle 34.

The cart 20 has a single linear cam 36 attached to the top of the receiver 30 in a position chosen so that the axis of the linear cam 36 is parallel to the axis of a connecting bar 32 clamped in the receiver 30. This centrally disposed cam 36 is used in lieu of the two linear cam sections formed on parallel rails of the perimeter frame in U.S. Pat. No. 5,176,426. The new arrangement provides a significant performance improvement in that the cutter wheel 25 is moved to one end of the apparatus carried by the cart 20 instead of being mounted within a perimeter frame. Moving the cutting wheel 25 near the end of the cart 20 allows an operator to work closer to obstructions (e.g., walls) and to make a groove that extends to the edge of a paved surface. When using the perimeter-frame apparatus of U.S. Pat. No. 5,176,426, the operator had to either stop grooving when a wheel at a corner of the perimeter frame reached the edge of the level paved surface, had to or provide a temporary support (e.g. a piece of lumber laid on the turf) for the affected wheel to ride on. In many cases a groove made with the perimeter frame apparatus of U.S. Pat. No. 5,176,426 had to be stopped some five to twenty centimeters from an edge or an obstruction.

The perimeter frame apparatus of U.S. Pat. No. 5,176,426 had an oblong rectangular frame, so that one could refer to grooves made with that apparatus as being "longitudinal" or "transverse", depending on a groove's orientation with respect to the axis of the frame. The present apparatus is not restricted to the same sort of "footprint" as was the earlier apparatus, and may sometimes employ a cart 20 that is wider than it is long. Nonetheless, cuts or grooves made in a direction parallel to the axis of the receiver 30 or linear cam 36 are hereinafter referred to as longitudinal, regardless of the aspect ratio of the cart 20, and are generally made by holding the cart 20 stationary and pushing the cutting wheel 25 across the surface 24. "Transverse grooves", on the other hand, are perpendicular to the longitudinal grooves, and are commonly made by pushing the cart 20 across the surface 24.

Figure 2:
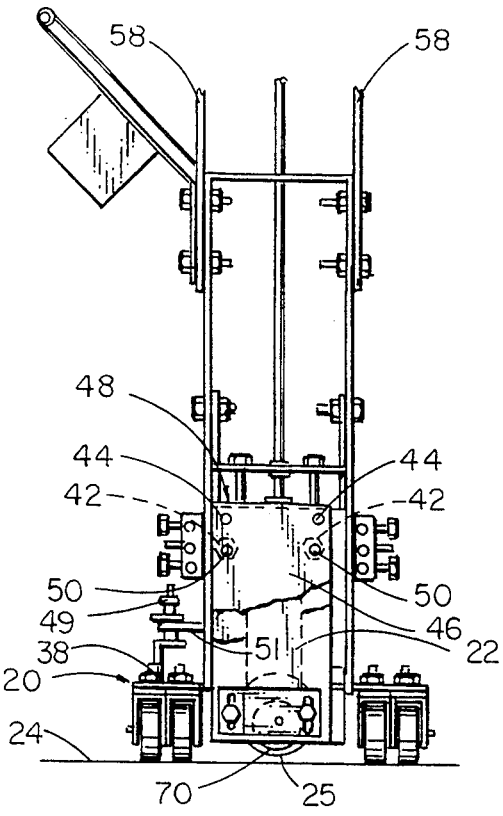
FIG. 2 of the drawing is a front elevational view of the carriage end of the cutter-carrying cart with the cutting blade set up for a transverse cut.
Figure 3:
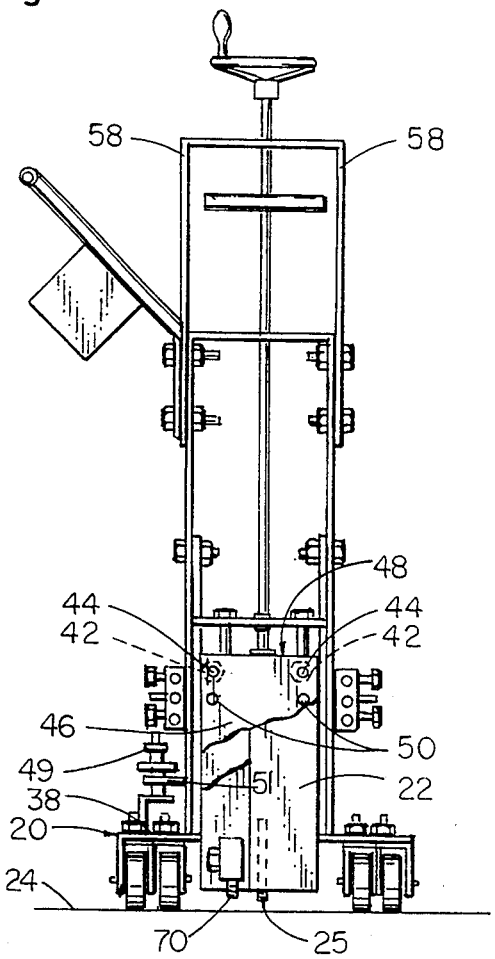
FIG. 3 of the drawing is a front elevational view of the carriage end of the cutter-carrying cart with the cutting blade set up for a longitudinal cut.

The apparatus of the present invention also differs from that of U.S. Pat. No. 5,176,426 in that it may use a single cutter 22 mounted in two different orientations for the transverse and longitudinal grooves. FIG. 2 of the drawing shows a rotary cutter 22 aligned to make a transverse groove and retained by screws 42 that pass through a set of aligned holes 44 in a wall 46 of a carriage 48. FIG. 3 of the drawing shows the corresponding set-up for making grooves with a perpendicular orientation (i.e., longitudinal grooves). Here, the cutter 22 has been rotated 90° about a vertical axis and affixed to a different set of aligned holes 50. Although a simple screw mounting arrangement is shown in FIGS. 2 and 3 of the drawing, it will be understood that other known repositionable fastening arrangements involving fixed stops, keyways, pivotal mountings and the like could also be used to set the position of the cutter 22 on the carriage wall 46. It will also be understood that the repositioning operation may involve moving only the cutter 22 from one wall to another, or the operation may involve leaving the cutter 22 fixed within a protective enclosure that is reoriented.

As will be described in greater detail hereinafter, the control of the depth of both transverse and longitudinal grooves involves a contour-following wheel, which may be either a cam-following wheel (e.g., for the longitudinal grooves) or a terrain-following wheel (e.g., for the transverse grooves).

Turning again to FIG. 2 of the drawing, one finds the apparatus of the invention set up for a transverse cut with the cutter 22 mounted in the lower set 44 of holes. This keeps the carriage 48 relatively higher off the surface 24 so that the cam-following wheel 54 is held above and out of contact with the upper portion 56 of the linear cam 36, regardless of the vertical position of the carriage 48. The same essential feature of keeping the longitudinal control apparatus from interfering with the transverse depth control apparatus can also be provided by using a cam following wheel 54 that is readily demountable. If one uses a demountable cam following wheel 54, the cutter 22 can be mounted in the carriage 48 at the same height for both longitudinal and transverse grooves.

Figure 5:
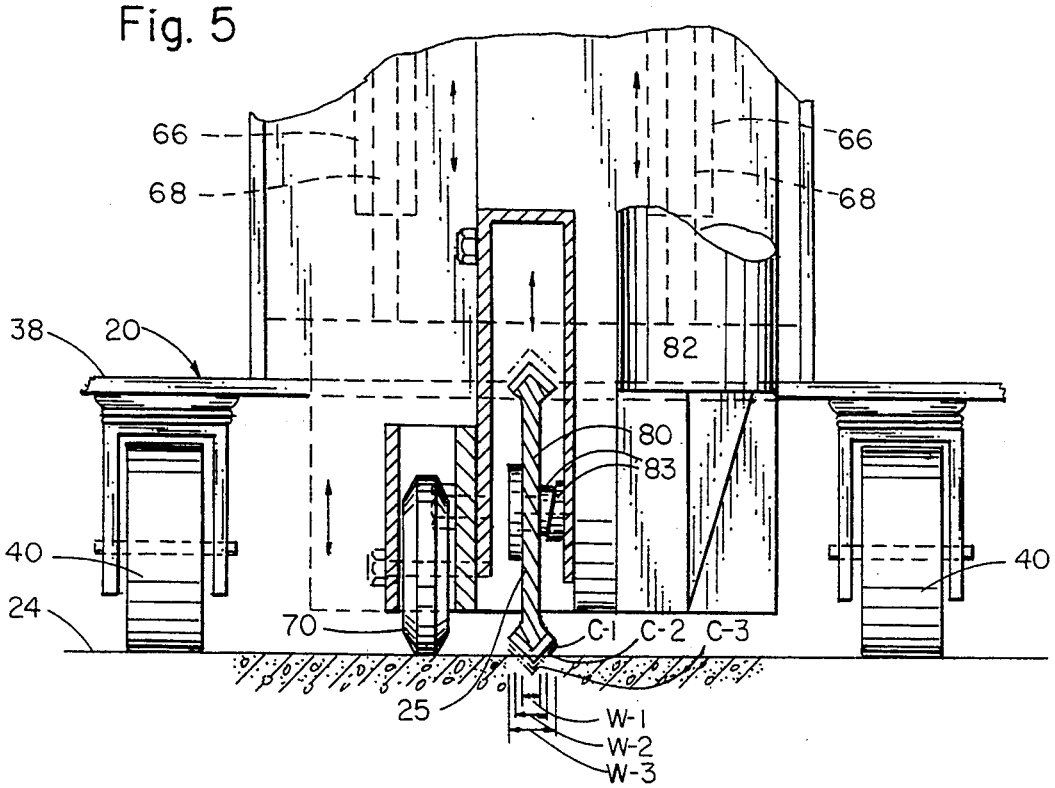
FIG. 5 of the drawing is a cut-away view of the carriage showing a cutter and eccentric terrain-following wheel set up to make a "cobblestone" groove pattern.

The transverse groove (e.g., the arcuate one if one is cutting a circular pattern) is preferably made with the carriage 48 as close as possible to the base 38 of the cart—i.e., with the generally upstanding frame 58, which is attached to the end of the horizonal bearing shafts 60 that move within horizonal bearing housings 61, moved to a retracted limiting position. The frame 58 may be locked in this position with a locking clamp 49, or with the clamp 49 and collars 62, on the cart 20 that engages an element 51 affixed to the frame 58. The elevation of the carriage 48 is then set by turning the jackscrew 64 so that the carriage 48 (which has vertical bearing housings 66 attached to it) is carried downward along the vertical bearing shafts 68 and the cutting wheel 25 is brought into operative contact with the pavement surface 24. When the cutting wheel 25 has been lowered, the cart 20 can be pushed across the surface 24 under the control of guidance apparatus such as that disclosed in U.S. Pat. No. 5,176,426, or of improvements thereto that will be discussed subsequently herein. The terrain-following wheel 70 is used to control the depth of cut. If a normal wheel, as shown in FIG. 2, is used for the terrain-following wheel, the depth of cut will remain constant along the groove. If an eccentrically mounted, or non-circular terrain-following wheel 70 (e.g., as shown in FIG. 5) is employed, the depth of cut can be varied along the groove. The use of varying depth cuts to make various decorative patterns will be discussed subsequently with reference to FIG. 6 of the drawing.

The longitudinal grooves, which are normally made after the generally longer transverse grooves have been cut, are made by holding the cart 20 stationary with respect to the surface 24 and moving the frame 58, carriage 48, and cutting wheel 25 along a horizontal line defined by the guide shafts 60. Although the preferred apparatus illustrated in the drawing employs a single linear cam 36 and two guide shafts 60 for this purpose, it will be understood that alternate arrangements would produce the same result.

The longitudinal groove may be limited in extent by stops 62 on the horizontal guide shafts 60, and by selecting the position of the linear cam 36 on the cart 20. The cam 36 is bolted to the top of the receiver 30, and may be relocated to any of a plurality of predetermined positions by translating it along its mounting axis. A longitudinal groove is usually made with the apparatus of the invention by positioning the cart 20 in a position chosen so that the cutter 25 is lowered to the concrete surface 24 at the right place when the cam-following wheel 54, which is mounted on a wheel-mounting member 55 extending from a wall 46 of the carriage 48, rolls down the lead-in ramp 76 of the linear cam 36. The cart 20 may be held stationary with a brake (not shown) while the carriage 48, which is mounted to the upstanding frame 58, is pushed away from the body 38 of the cart 20 to make the longitudinal groove.

It is noteworthy that when the cutter wheel 25 is positioned for a longitudinal groove, a fictitious vertical line drawn through the center of the cutting wheel 25 intersects a fictitious line formed by extending the axis of the connecting bar 32. Thus, if one is making a generally circular decorative pattern with radial and arcuate grooves as shown in U.S. Pat. No. 5,176,426, the nominally radial (longitudinal) grooves are indeed radial. The apparatus taught in U.S. Pat. No. 5,176,426, on the other hand, made nominally radial grooves that were offset a fixed amount from a true radius of the pattern. This offset produced a distortion in the pattern that was most noticeable at short radii.

Figure 6:
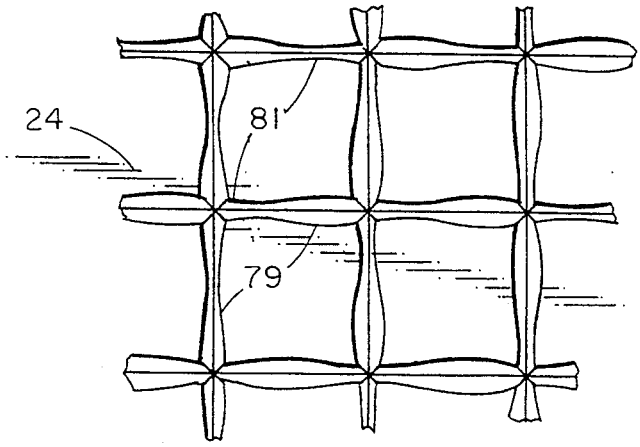
FIG. 6 of the drawing is a plan view of "cobblestone" grooving produced by the apparatus of the invention.
Figures 4A, 4B:
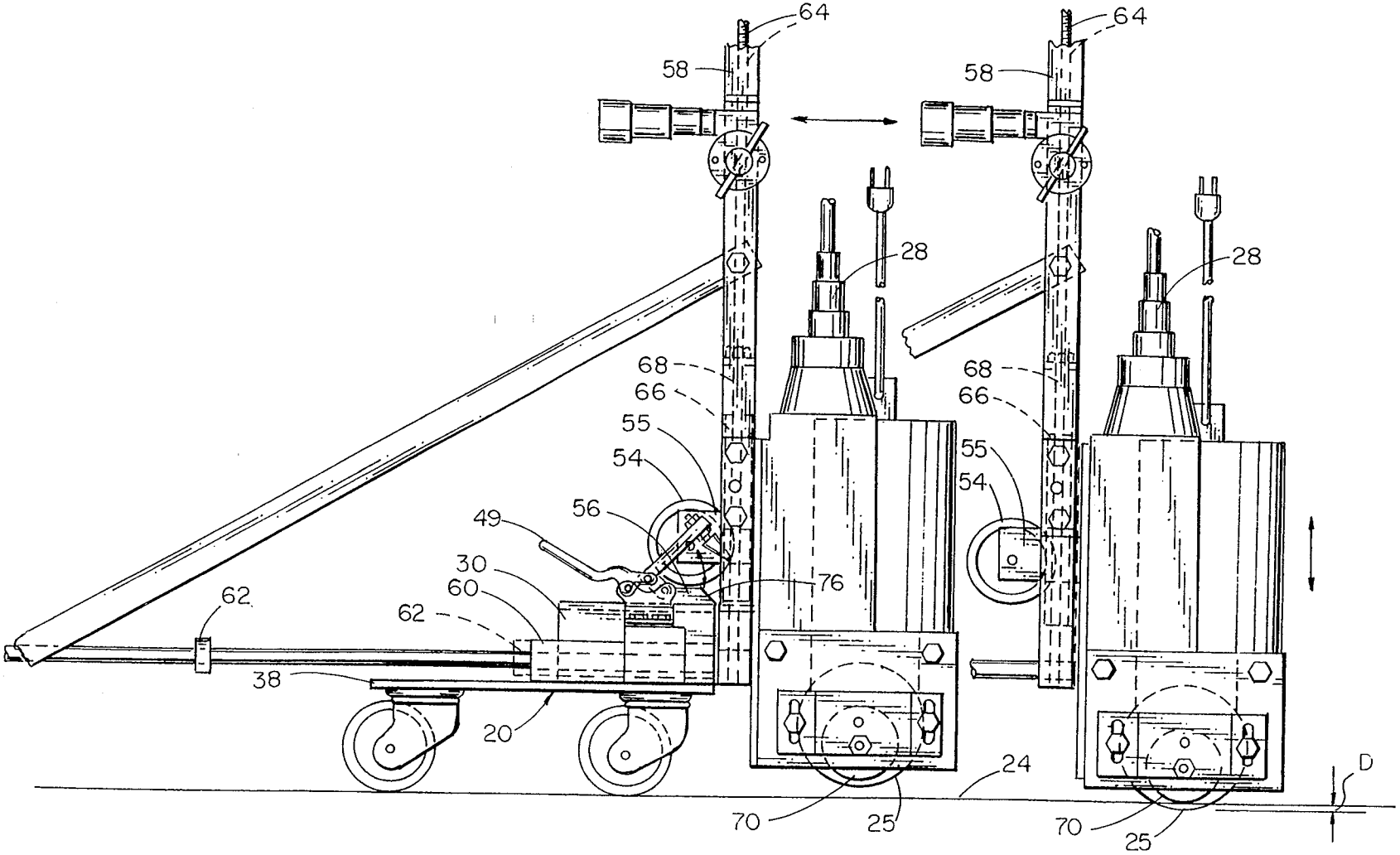
FIG. 4*a* of the drawing is a side elevational view of the cutter-carrying cart set up in preparation for making a longitudinal cut.
FIG. 4*b* of the drawing is a side elevational view of a portion of the apparatus of FIG. 4*a* showing the carriage extended and the cutter wheel engaging the pavement surface.

As discussed previously herein, the use of eccentric or non-circular contour-following wheels for the terrain-following wheel 70 can produce a groove of varying depth. If a cutter wheel 25 has a non-square cross sectional profile 80 (e.g., vee, u, semi-vee, flat-bottomed vee etc. profiles), as shown in FIG. 5 of the drawing (which also shows a square cross-sectional profile 82 in phantom), then the width of a groove (shown as w1, w2, w3 in FIG. 5) will vary with its depth (e.g., c1, c2, c3 in FIG. 5). Hence, the combination of a non-square profile 80 and an eccentric or non-circular contour-following wheel can be used to yield a variety of groove patterns in which the width of a groove varies along its length. A cobblestone-like or "wavy" pattern that may be prepared by this combination of cutter and contour-following wheels is shown in FIG. 6 of the drawing, where narrower portions 81 of the grooves are cut when the wheel 25 is lifted upwards, and the widest portions 79 are cut when the wheel 25 is at its greatest depth. It should be noted that although one could also use an eccentric wheel for the cam-following wheel 54, this is seldom done in practice, because longitudinal cuts are not substantially longer than the circumference of commonly employed cam-following wheels.

The width of a groove cut by a given cutting wheel may also be varied with the apparatus of the invention by shimming the cutter 22 so that the cutting wheel 25 is skewed to the axis of the groove and thereby makes a wider kerf that has a fixed width along its length. This may be done, for example, by inserting a shim 83 when mounting the cutting wheel 25 on the cutter 22, or by shimming the cutter 22 with respect to the carriage 48.

Figure 7:
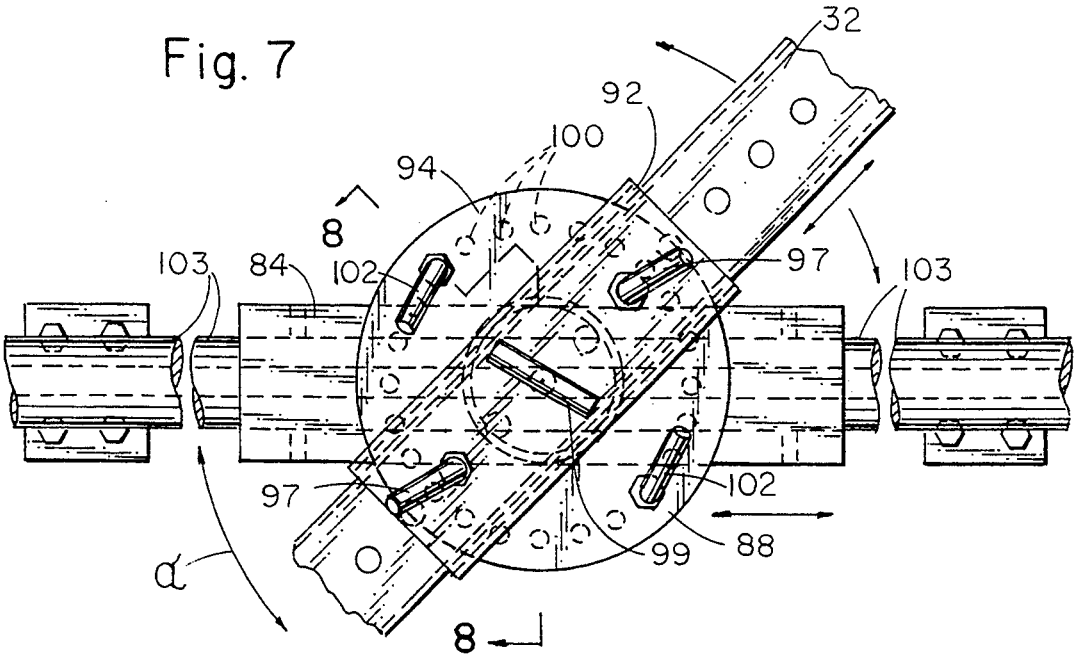
FIG. 7 of the drawing is a plan view of a tracking arrangement of the invention that is adjustable to make herringbone, diamond or other groove patterns.
Figure 8:
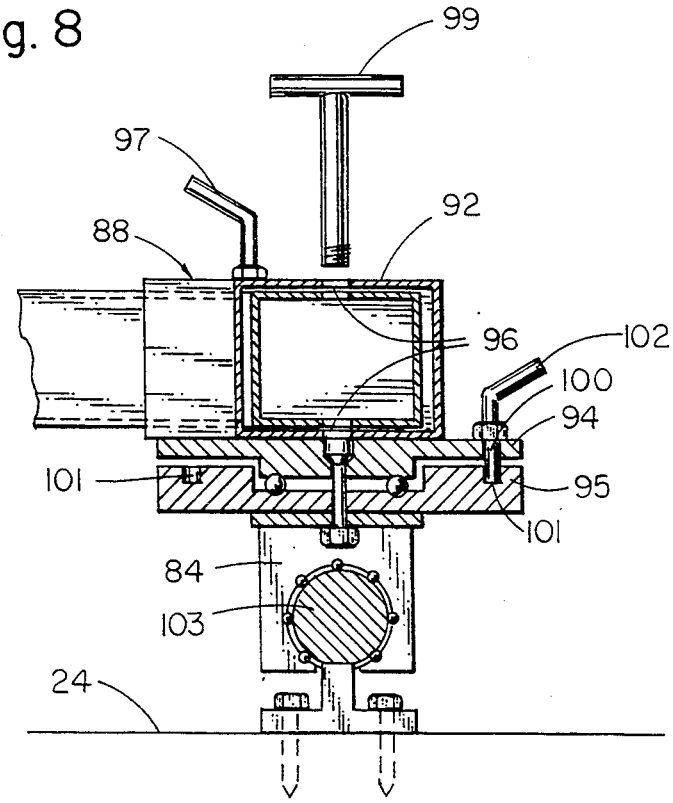
FIG. 8 of the drawing is a cross-sectional view of the apparatus of FIG. 7 taken along the plane of section indicated by 8—8 in FIG. 7.

Additional control of the decorative patterning capability of the apparatus of the invention is provided by selecting the angle (shown as $\alpha$ in FIG. 7 of the drawing) between the connecting bar 32 and a linear sliding member 84 attached to the connecting bar 32 at that end of the bar distal from the cart 20. In a preferred embodiment the angle $\alpha$ is set to one of a plurality of predetermined settings at a joint pivotal about a vertical axis, the joint being made between the connecting arm clamp 88 and the linear sliding member 84. As seen in FIGS. 7 and 8 of the drawing, the connecting arm clamp 88 comprises a tubular member 92 and a circular base 94. As was taught in U.S. Pat. No. 5,176,426, the tubular member 92 includes a plurality of throughholes 96 through which screws 97, pins, or other suitable fasteners may be inserted to retain the connecting bar 32. The selection of one of a plurality of predetermined angular settings is preferably achieved by pivoting the connecting arm clamp 88 about a pivot bolt 99 so as to align a plurality of throughholes 100 in the base 94 with a corresponding plurality of holes 101 in the circular upper portion 95 of the linear sliding member 84, and by then attaching the sliding member 84 and connecting arm clamp 88 with bolts 102 or other fasteners.

It will be understood that although it is convenient to provide a joint pivotable about a vertical axis between the connecting bar 32 and the linear sliding member 84, other locations for the joint could also be selected. One could, for example, provide a comparable lockable pivoting joint at the receiver 30, or a lockable pivoting structure could be provided at an arbitrarily selected position along the connecting bar 32.

Figure 9:
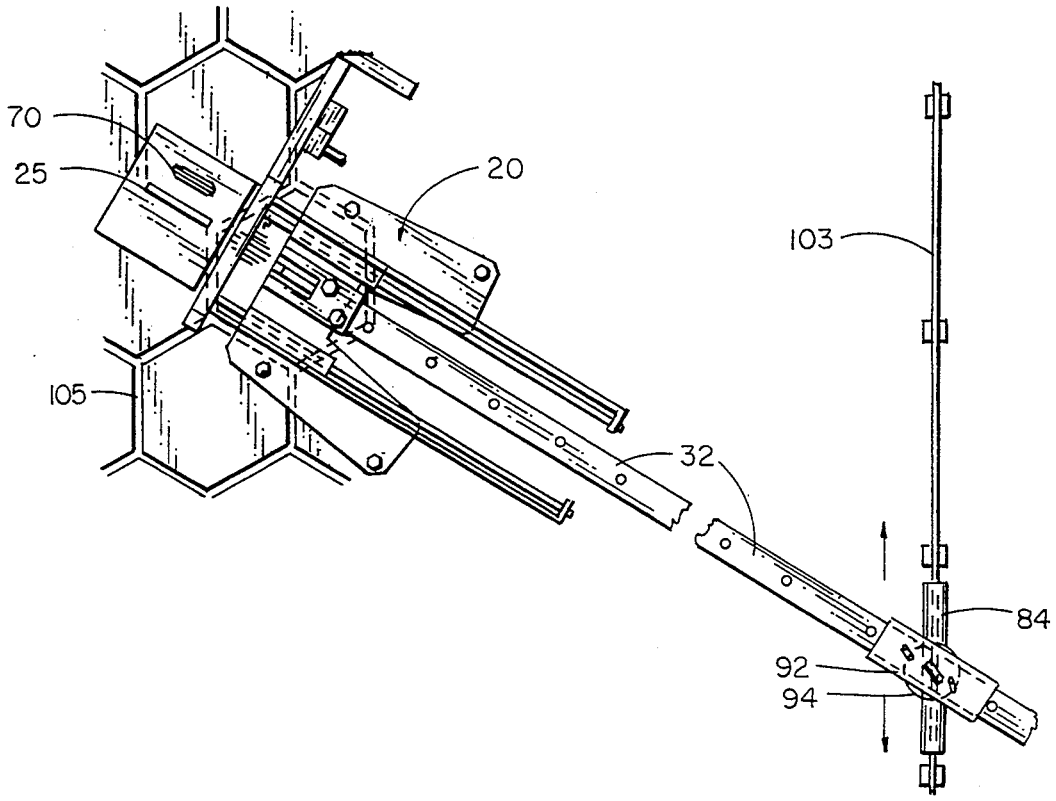
FIG. 9 of the drawing is a plan view of the apparatus of guidance apparatus of FIG. 7 being used to form a hexagonal groove pattern. The rotary cutter and other details have been omitted from the figure in the interest of a clearer presentation of the relationship between the guidance apparatus and the cutting wheel.

The above approach allows the operator to control the angle, indicated as $\alpha$ in FIG. 7, between the connecting arm 32 and the linear sliding member 84, and thereby selectively make one of number of decorative grooved patterns without having to re-position the guide bar 103. As is shown in the plan view of FIG. 9, by setting the angle $\alpha$ sequentially to 60°, 0°, and −60° one can cut a set of grooves that cover the surface 24 with an array of hexagons 105. It will be understood that other sets of angular settings can be used to form a wide variety of other patterns, such as herringbone, diamond, etc.

Figure 10:
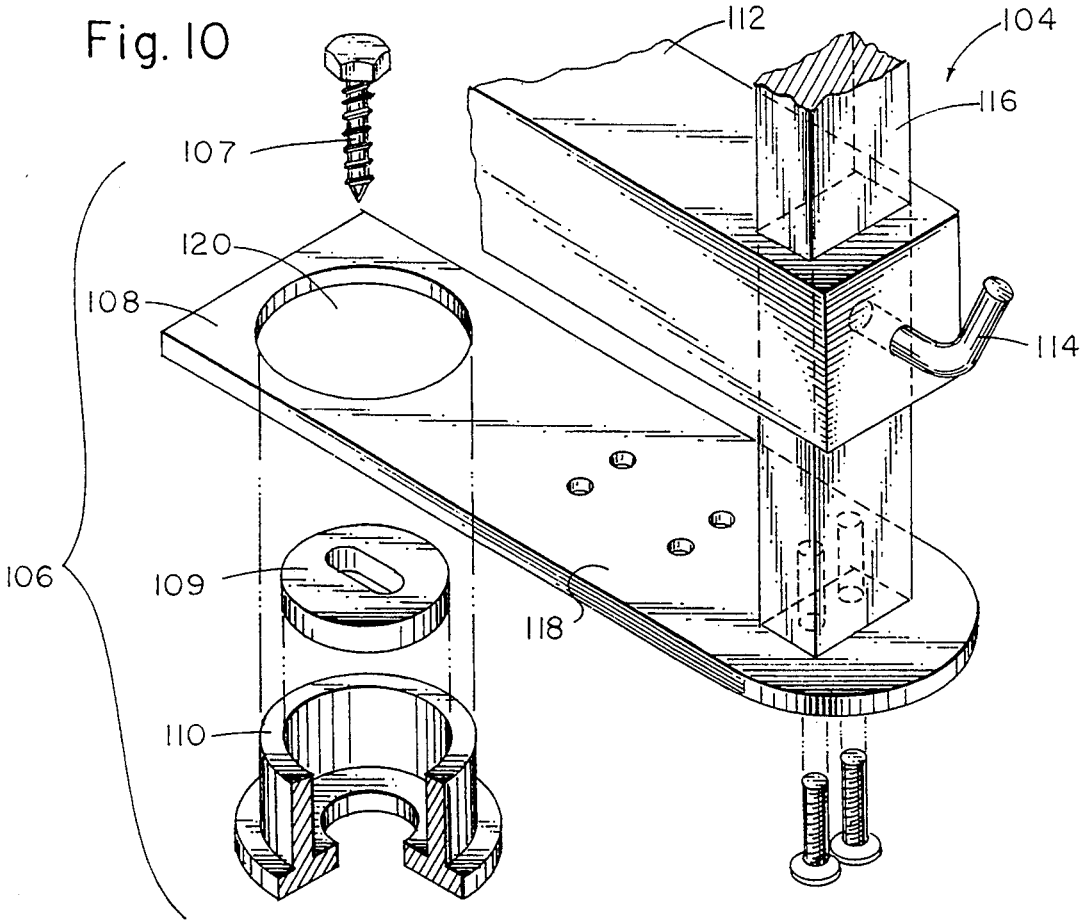
FIG. 10 of the drawing is a partially exploded perspective view of a composite connecting arm structure useful for making small arcuate grooves.

Turning now to FIG. 10 of the drawing, one finds guide apparatus of the invention that permits the operator to make arcuate grooves having a radius comparable to, or smaller than the length of the cart 20. Previous teaching of the guidance apparatus, e.g., in U.S. Pat. No. 5,176,426, was directed at a generally straight connecting arm 32 that allowed pivotal motion about a center of the arc some distance from the cutter 22. For making smaller circular grooves a bent or sectional connecting arm 104 may be employed. One end of the arm 104 is attached within the receiver 30, while the other end of the arm 104 extends to a pivotal joint 106. The joint 106 may be made of a "tophat" shaft member 110 rigidly attached to the concrete surface 24 (e.g., by screw 107 and slotted washer 109) and a mating portion 108 of the arm 104. The composite connecting arm 104 is shown in FIG. 10 as comprising a straight segment 112 that attaches to the receiver 30 (not shown in FIG. 10 in the interest of clarity) and that has a screw clamp 114 at the end distal from the cart 20, a vertical shaft portion having a non-circular cross section 116, and a tongue-like portion 118 with a circular throughhole 120 of an appropriate diameter so that it can be lowered over the tophat 110. It will be understood that a wide variety of other known approaches to attaching one end of the connecting arm to the cart directly above the center of arc of the groove (e.g., a single "C-shaped" connecting arm 32 curved by at least 90° of arc about a fictitious horizontal line drawn perpendicular to the axis of the receiver 308), could be used in place of the composite "double-elbowed" connecting arm structure illustrated in FIG. 10.

Figure 11:
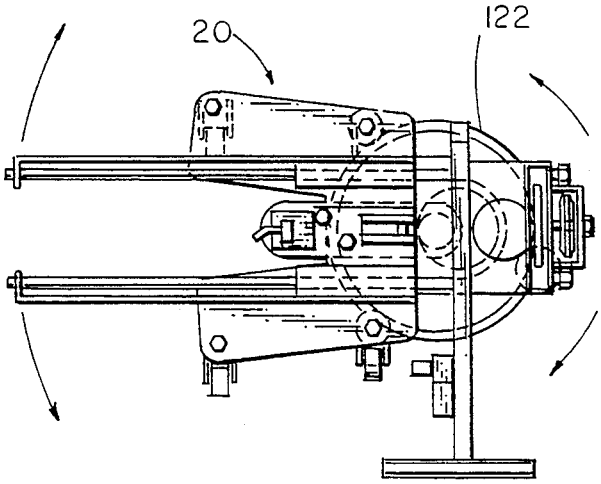
FIG. 11 of the drawing is a plan view of the apparatus of FIG. 10 being used to form a small circular groove. As in FIG. 9, detail has been omitted to better show the relationship between the guidance apparatus and the cutting wheel.

The use of the apparatus of FIG. 10 to make a decorative grooving pattern that employs small circles is shown in FIG. 11 of the drawing. A pattern of circular grooves 122 cut about centers 124 can subsequently be interconnected by a corresponding plurality of straight grooves to yield any of a number of decorative patterns (e.g., a square array of small circles).

Although the present invention has been described with respect to several preferred embodiments, many modifications and alterations can be made without departing from the invention. Accordingly, it is intended that all such modifications and alterations be considered as within the spirit and scope of the invention as defined in the attached claims.

What is claimed is:

1. Apparatus for decoratively grooving a hardened pavement surface, said apparatus comprising, a cart having ground engaging support wheels, an elongate horizontal linear bearing housing having an axis, said housing attached to said cart, a horizontal guide shaft movably disposed within said horizontal housing, said horizontal guide shaft having two ends, an upstanding frame attached to said first end of said horizontal guide shaft and translated thereon between a first limiting position at which said frame is proximal to said cart and a second limiting position at which said frame is distal from said cart, said frame comprising a vertical guide shaft, a vertically oriented jackscrew having two ends, a first said end of said jackscrew operationally connected to said frame, a carriage operationally connected to said second end of said jackscrew, said carriage comprising a vertically oriented linear bearing housing relatively moveable about said vertical guide shaft, said carriage further comprising selective mounting means mounting a pavement-grooving cutting wheel perpendicular to said surface, said mounting means selectively mounting said wheel in either of two mutually perpendicular predetermined orientations, a first contour-following wheel attached to said carriage, said first contour-following wheel oriented parallel to said cutting wheel, a linear cam attached to said cart parallel to said horizontal bearing housing, said linear cam having a lead-in ramp adjacent said frame and a raised portion distal from said frame, and a wheel mounting member extending outward from said carriage above said cart, a second contour-following wheel mounted on said mounting member, said second contour-following wheel parallel to said axis of said horizontal bearing housing.

2. Apparatus of claim 1, wherein said cart comprises an elongate connecting bar receiver having an axis parallel to said horizontal bearing housing, said apparatus further comprising an elongate connecting bar having two ends, the first said end thereof attached to said receiver, said second end of said bar attached to a pivotal connection to said surface, wherein a first fictitious vertical line drawn through the center of said cutting wheel intersects a second fictitious line drawn as an extension of the axis of said receiver.

3. Apparatus of claim 2 wherein said mounting means comprise a shim mounting said cutting wheel in an orientation skewed to said axis of said receiver.

4. Apparatus of claim 1 wherein a said contour-following wheel is eccentrically mounted.

5. Apparatus of claim 1 wherein a said contour-following wheel is not round.

6. Apparatus of claim 1 wherein said cutting wheel has a non-square cross-sectional profile.

7. Apparatus of claim 1 wherein if said cutting wheel is mounted in said first predetermined orientation, said cutting wheel is parallel to said axis of said horizontal bearing housing and said cutting wheel extends a first predetermined distance below a bottom of said carriage, and if said cutting wheel is mounted in said second predetermined orientation, said cutting wheel is perpendicular to said axis of said horizontal bearing housing and said cutting wheel extends a second predetermined distance below said bottom, said second predetermined distance greater than said first predetermined distance.

8. A method of grooving a hardened concrete surface using apparatus comprising a cart having disposed thereon an elongate horizontal linear bearing housing; a horizontal guide shaft moving within the horizontal housing; an upstanding frame attached to a first end of the horizontal guide shaft and translated thereon between a first limiting position at which the frame is proximal to the cart and a second limiting position at which the frame is distal from the cart, the frame comprising a vertical guide shaft; a carriage comprising a vertically oriented linear bearing housing moving along the vertical guide shaft, the carriage further comprising mounting means mounting a pavement-grooving cutting wheel perpendicular to the surface and parallel to the horizontal bearing housing; a first contour-following wheel attached to the carriage, the first contour-following wheel oriented parallel to the cutting wheel; a linear cam attached to the cart parallel to the horizontal bearing housing, the linear cam having a lead-in ramp adjacent the frame and a raised portion distal from the frame; and a wheel mounting member extending outward from the carriage above the cart, a second contour-following wheel mounted on the mounting member, the second contour-following wheel parallel to the horizontal bearing housing; the method comprising the steps of:

a) translating the upstanding frame to the first limiting position and thereafter lowering the carriage, thereby bringing the second contour-following wheel into operative contact with the raised portion of the linear cam and holding the cutting wheel above the surface, b) translating the upstanding frame from the first limiting position toward the second limiting position, whereupon the second contour-following wheel rolls down the lead-in ramp portion of the linear cam and comes into operative contact with the surface, and c) translating the frame to the second limiting position, thereby making a groove of a predetermined length in the pavement.

9. Guided apparatus for decoratively grooving a hardened concrete surface, said apparatus comprising a cart having ground-engaging support wheels, said cart comprising means for mounting a pavement grooving cutting wheel in operative contact with said surface, and connecting means connecting said cart to a linear sliding member, said linear sliding member mounted for linear sliding motion only to a linear slide bar rigidly mounted parallel to said surface, said connecting means comprising a joint pivotable about a vertical axis, said joint lockable at a predetermined angular position.

10. Apparatus of claim 9 wherein said connecting means comprise an elongate connecting arm attached at an end thereof to said cart, a portion of said arm distal from said cart attached to an arm clamp pivotable about a pivot bolt attached to said linear sliding member.

11. Guided apparatus forming an arcuate groove in a hardened concrete surface, the apparatus comprising a cart having ground-engaging support wheels, the cart comprising means for mounting a cutting wheel in operative contact with the surface, and a connecting arm having two ends, the first end of the arm attached to the cart at a point directly above the center of arc of the groove, the second end of the arm pivotally connected to the surface at the center of arc of the groove.

12. Apparatus of claim 11 wherein the arm comprises a plurality of segments, a first of the segments extending from an elongate connecting arm receiver disposed on the cart to a clamping means, the clamping means clamping the first segment to a second segment of the arm, the second segment comprising a circular hole therethrough distal from the clamping means, the arm pivotally connected to the surface by an upstanding rigid shaft attached to the surface, the shaft extending upwards from the surface through the hole.

13. A method of decoratively grooving a hardened concrete surface comprising the steps of a) mounting a cutting wheel having a non-square profile to a rotary cutter, b) attaching the cutter to a cart comprising means holding the cutting wheel in operative contact with the surface, c) mounting to the cart a terrain-following wheel raising and lowering the cutter responsive to the motion of the cart across the surface, d) attaching the cart to guidance means comprising an elongate connecting arm attached at a first end thereof to the cart, the connecting arm attached at a second end thereof to a linear sliding member, the linear sliding member mounted for linear sliding motion only to a linear slide bar rigidly mounted parallel to the surface and e) moving the cart across the surface under the control of the guidance means.

14. The method of claim 13 wherein the terrain-following wheel comprises a wheel eccentrically attached to the cart.

15. The method of claim 13 wherein the terrain-following wheel comprises a non-circular contour-following wheel.

* * * * *